US008210889B2

(12) United States Patent
Reith et al.

(10) Patent No.: US 8,210,889 B2
(45) Date of Patent: Jul. 3, 2012

(54) INFRARED EMITTER COMPRISING AN OPAQUE REFLECTOR AND PRODUCTION THEREOF

(75) Inventors: Volker Reith, Johannesberg (DE); Sven Linow, Darmstadt (DE)

(73) Assignee: Heraeus Noblelight GmbH, Hanau (DE)

( * ) Notice: Subject to any disclaimer, the term of this patent is extended or adjusted under 35 U.S.C. 154(b) by 201 days.

(21) Appl. No.: 12/527,705

(22) PCT Filed: Jan. 17, 2008

(86) PCT No.: PCT/EP2008/000322

§ 371 (c)(1),
(2), (4) Date: Aug. 19, 2009

(87) PCT Pub. No.: WO2008/101573

PCT Pub. Date: Aug. 28, 2008

(65) Prior Publication Data

US 2010/0117505 A1 May 13, 2010

(30) Foreign Application Priority Data

Feb. 20, 2007 (DE) ..... 10 2007 008 696

(51) Int. Cl.
*H01J 5/16* (2006.01)
*H01J 9/00* (2006.01)

(52) U.S. Cl. ..... 445/23; 313/113; 313/318.07; 313/627

(58) Field of Classification Search ..... 313/627–643, 313/567, 25, 26, 318.01–318.02; 445/26–27, 445/22; 439/226
See application file for complete search history.

(56) References Cited

U.S. PATENT DOCUMENTS

| | | | | |
|---|---|---|---|---|
| 2,980,820 | A | 4/1961 | Brundige et al. | |
| 4,254,300 | A | 3/1981 | Thompson-Russell | |
| 5,003,284 | A | 3/1991 | Dieudonne | |
| 5,138,227 | A * | 8/1992 | Heider et al. | 313/623 |
| 6,122,438 | A | 9/2000 | Scherzer et al. | |
| 7,238,262 | B1 * | 7/2007 | Bartolomei et al. | 204/192.26 |
| 2003/0175020 | A1 | 9/2003 | Fuchs et al. | |
| 2006/0038470 | A1 * | 2/2006 | Maul et al. | 313/113 |
| 2008/0075949 | A1 | 3/2008 | Kirst et al. | |

FOREIGN PATENT DOCUMENTS

| | | | |
|---|---|---|---|
| DE | 29 47 230 | A1 | 6/1980 |
| DE | 198 22 829 | A1 | 11/1999 |
| DE | 102 11 249 | A1 | 10/2003 |
| DE | 102 53 582 | B3 | 7/2004 |
| DE | 10 2004 051 846 | A1 | 3/2006 |
| DE | 10 2004 052 312 | A1 | 3/2006 |
| EP | 0 372 166 | A2 | 6/1990 |
| EP | 0 959 645 | A2 | 11/1999 |
| EP | 1 344 753 | A1 | 9/2003 |

OTHER PUBLICATIONS

Office Action Issued Feb. 25, 2011 in CN Application Ser. No. 200880005715.9.

* cited by examiner

*Primary Examiner* — Tracie Y Green
(74) *Attorney, Agent, or Firm* — Panitch Schwarze Belisario & Nadel LLP

(57) ABSTRACT

A method is provided for producing an infrared emitter made of an endless quartz glass body, wherein a reflector layer is deposited at least partially on the surface of the body made of quartz glass. The quartz body is divided into individual sections after application of the reflector layer. An infrared emitter is also provided.

7 Claims, 3 Drawing Sheets

INFRARED EMITTER COMPRISING AN OPAQUE REFLECTOR AND PRODUCTION THEREOF

CROSS-REFERENCE TO RELATED APPLICATION

This application is a §371 of International Application No. PCT/EP2008/000322, filed Jan. 17, 2008, which was published in the German language on Aug. 28, 2008 under International Publication No. WO 2008/101573 A2, which is incorporated herein by reference in its entirety.

BACKGROUND OF THE INVENTION

The invention relates to a method for producing an infrared emitter from a quartz body having an endless form, wherein a reflector layer is deposited at least partially on the surface of the body made of quartz glass. The invention also relates to an infrared emitter produced in this way.

Components made of quartz glass are used for a plurality of applications, for example in lamp manufacturing for envelope tubes, bulb cover plates, or reflector carriers for lamps and emitters in the ultraviolet, infrared, and visible spectral ranges. Here, for generating special spectral properties, the quartz glass is doped with other substances.

Quartz glass is distinguished from other glasses by a low coefficient of expansion, by optical transparency across a wide range of wavelengths, and by high chemical and thermal stability.

When making lamps, the time constancy of power, the spatial orientation, and the efficiency of the output radiation play an important role. In order to minimize radiation losses or to direct the radiation selectively, optical emitters are provided with a reflector. Here, the reflector is either connected rigidly to the emitter or it may be a reflector component arranged separate from the emitter.

U.S. Pat. No. 2,980,820 describes a short-wavelength infrared emitter.

In German published patent application DE 198 22 829 A1, an infrared emitter is disclosed in which the lamp tube is constructed in the form of a so-called twin tube. Here, a quartz glass envelope tube is divided by a longitudinal crosspiece into two sub-spaces running parallel to each other, wherein a heating coil runs in one or in both sub-spaces. The side of the twin tube facing away from the main emission direction of the infrared radiation is coated with a gold layer, which acts as a reflector. This gold layer has, in the new state, a reflectivity of >95% across the entire infrared and withstands a continuous temperature of a maximum of 600° C. At higher temperatures, bonding losses and the evaporation of gold lead to a loss of the reflective property even after a short time.

In German published patent application DE 102 11 249 A1, a bright gold preparation is described that can be operated continuously up to a maximum temperature of 750° C. and, for a short time, far above this value, without resulting in the effects described above. Based on its composition, however, this gold features poor reflection of less than 70%, so that the effectiveness of this reflector does not satisfy the requirements placed on it.

Reflection layers made of gold with a high reflectivity of over 90% have, in general, the disadvantage that they are temperature stable only to a limited extent or else have a low reflectivity.

German published patent application DE 10 2004 051 846 A1 describes a quartz-glass component having a reflector layer. Here, the reflector layer is made at least partially of opaque quartz glass. To produce such a component with a reflector layer, it is necessary to apply the reflector to the empty emitter tube, in order to achieve the sintering of the layer as processing temperatures of 1250° and more are needed for the manufacturing process. At temperatures above 1100° C. quartz glass already softens noticeably. In particular, excess pressure in a quartz container then leads to inflation of the container. IR emitters are typically filled with argon at a pressure of 800 mbar to 1 bar, so that completed emitters would definitely be destroyed during the application of the reflector layer.

In the previously known method for producing emitters with a reflector layer, it is not possible to first coat the quartz body or the quartz tube and then to perform the pinching. The reflector can only be applied to the empty emitter tube, because the processing temperatures exceed 1250° C. Therefore, depending on the method, the reflector must be applied to the emitter tube before the beginning of the emitter production at the size required later. The reflector may not reach into the region of the pinched section. This is necessary, because the emitter tubes are heated uniformly with rotating burners during the pinching. In tubes with the described reflector layer due to the different amounts of quartz at the front and rear sides, either the coated side would not be adequately heated, in order to be able to pinch it, or the non-coated region of the tube would be heated too much, so that the quartz tube would become too viscous and would tear.

Typical pinching machines for filament bulbs are made of two opposing gas burners rotating about the quartz tube to be pinched. If the quartz tube is sufficiently hot for the pinching, then the two burners stop in their home position, so that the two pinching jaws can move together past the burners onto the quartz tube and in this way compress the quartz glass and seal molybdenum foil around it. The technique of pinching and using molybdenum foil is shown in German published patent application DE 29 47 230 A1.

Both burners are powered from a common supply line and thus essentially have the same burner output. The pinching can be triggered only when the entire tube has been sufficiently heated through. In this case, however, the part of the tube not covered with reflector material is becoming too viscous and starts to flow, so that the emitter can indeed usually be closed, but the shape of the pinched section is random and inadequate. In addition, very often non-sealed parts of the pinched section are observed, which are to be traced back to non-uniform temperatures of the glass or strongly deformed tube cross sections directly before the pinching. Using this method, the production output of emitters sufficient for sales could not be realized. Furthermore, the reject rate is very high, which increases the production costs.

If emitters with the same shape are to be produced in high numbers, then it can be tolerable with respect to production costs to individually coat already cut tube sections with the reflector material and to process them into emitters only after this point. The transition from the coated to the non-coated region then remains and indeed has a low-quality look and feel nearly independent of the application method, because it cannot be shaped economically to have a straight and clear construction—beads, spattering, cracks, threads, etc. negatively affect the visual impression.

In contrast, for a production of visually satisfactory emitters or for the production of small quantities of emitters with equal dimensions, the described method is complicated, very slow due to the finishing work that is often necessary, and expensive due to the plurality of tools and small batches.

BRIEF SUMMARY OF THE INVENTION

An object of the invention is to provide a method with which infrared emitters can be produced with opaque reflectors in a desired length and in small batches.

The method according to the invention for producing an infrared emitter made of an endless quartz body, wherein a reflector layer is deposited at least partially on the surface of the body made of quartz glass, provides that the quartz body is divided into individual sections after the reflector layer is applied. This method allows infrared emitters to be produced in a desired length. The infrared emitter therefore has a continuous coating.

Advantageously, a $SiO_2$ layer is deposited as a reflector layer. $SiO_2$ is distinguished by excellent chemical and thermal stability, as well as its mechanical strength. Furthermore, $SiO_2$ has a high stability to temperature changes. In addition, it has proven to be economical to apply a reflector layer made of $SiO_2$. The production of $SiO_2$ reflector layers made of quartz glass is described, for example, in German published patent application DE 10 2004 051 846 A1, which is hereby fully incorporated.

Here, it is further advantageous when the reflector layer is an opaque, diffuse scattering reflector layer.

The method according to the invention provides that the individual sections of the quartz body are pinched at their ends by at least one burner. Here, the individual sections of the quartz body are heated standing vertical or lying horizontal with two opposing burners moving preferably in the plane perpendicular to the emitter axis and perpendicular to the axis connecting the burners.

For this purpose, it is advantageous if the ends of the sections are pinched by two rotating burners.

It has been shown that it is advantageous when the two burners have different gas flows. This gas flow should be sufficient so that the entire area of the section to be pinched is sufficiently heated through at the same time, without overheating one part. Simultaneously, the inner pressure of the emitter tube can be adjusted by suitable regulation of the inert gas flowing through the tube, so that the quartz body is not inflated in the deformable region. Here, for horizontal pinching, it is advantageous if the flow rate of the lower flame is selected so that the deformable region of the quartz body experiences just a force counteracting the force of gravity.

The invention further provides an infrared emitter that has been produced with the method described above. If necessary, such an emitter could also be made in a desired length after the application of the coating and thus the reflector. Thus, such an emitter is conceivable in any length.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF THE INVENTION

Embodiment 1

Figure 1:
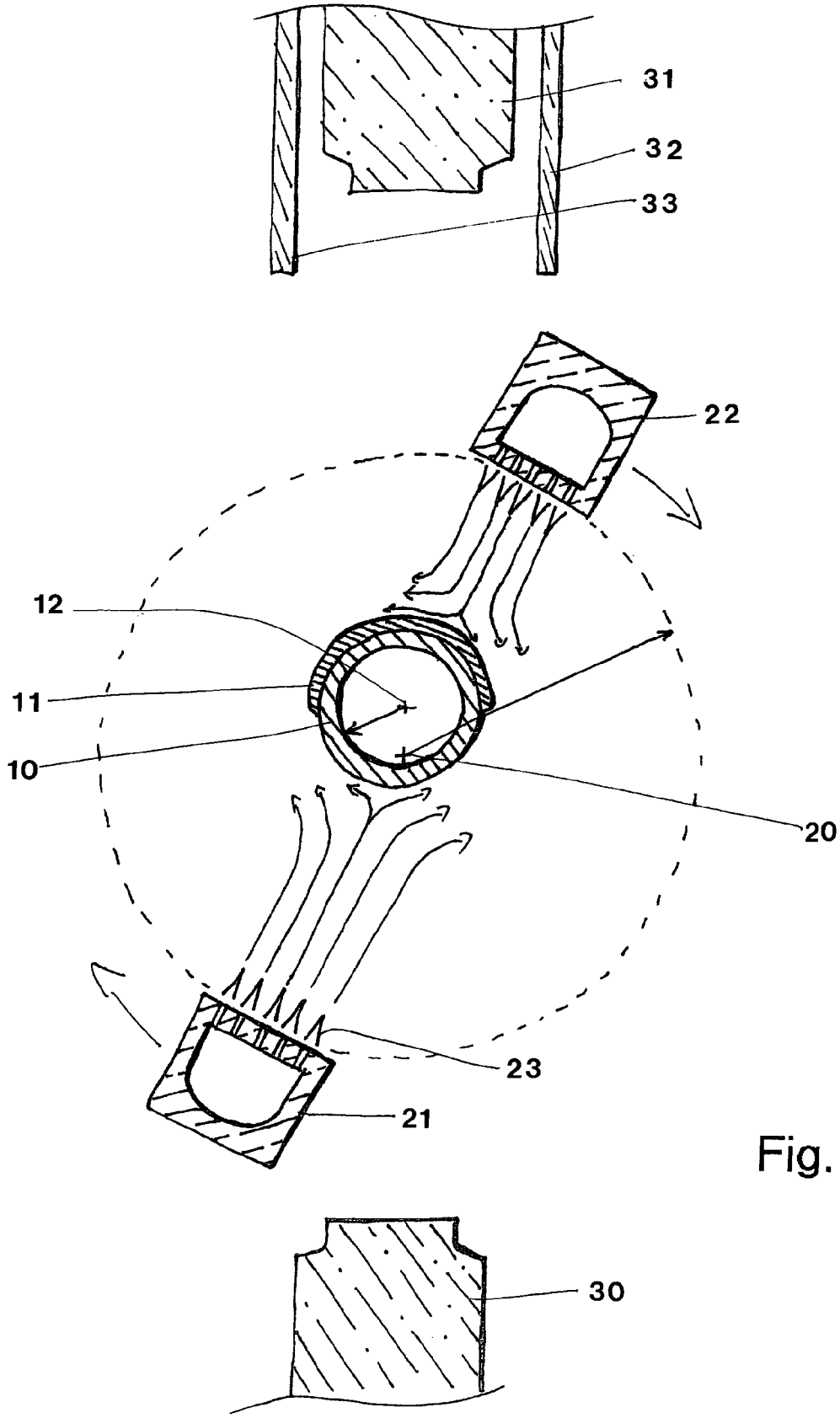
FIG. 1 is a schematic diagram of an arrangement for carrying out a method according to a preferred embodiment of the invention, with eccentrically rotating burners.

The system is shown in FIG. 1 with eccentrically rotating burners.

Deviating from the prior art, the emitter tube 10 with its coating 11 applied on one side is mounted for pinching not centered on the axis 20, about which the burners 21, 22 rotate, but instead its axis of symmetry 12 has an offset from position 20, such that the coated side is arranged significantly closer to the rotating burners than the non-coated side. The magnitude of the eccentricity to be selected here depends on the ratio of thickness of the applied layer to the emitter tube thickness and also on the properties of the flame, in particular the average temperature field.

For a flame with strong entrainment, a smaller eccentricity is sufficient, because the temperature of the flame falls off more quickly than in a laminar, far-reaching stable flame.

An envelope bulb pinching machine with two rotating, opposing burners 21, 22 with a burner spacing of 65 mm was converted for pinching round, tubes 13.7×1.5 mm, coated with a 1.0 mm reflector layer. The burners have, on a surface of 10×30 $mm^2$, five parallel rows of nozzles from which lean $H_2/O_2$ premixed flames flow. The flame fronts 23 formed in this way are rather stable, so that an eccentricity of 5 mm is sufficient here to generate a visually excellent and tight pinched section.

The tube is pinched by the two pinching jaws 30, 31 that move directly toward each other when the suitable quartz glass temperature is reached and when the burners 21, 22 are not in the way. Then the two auxiliary jaws 32, 33 clamp together, so that an H-shaped pinched section is produced.

Embodiment 2

Figure 2:
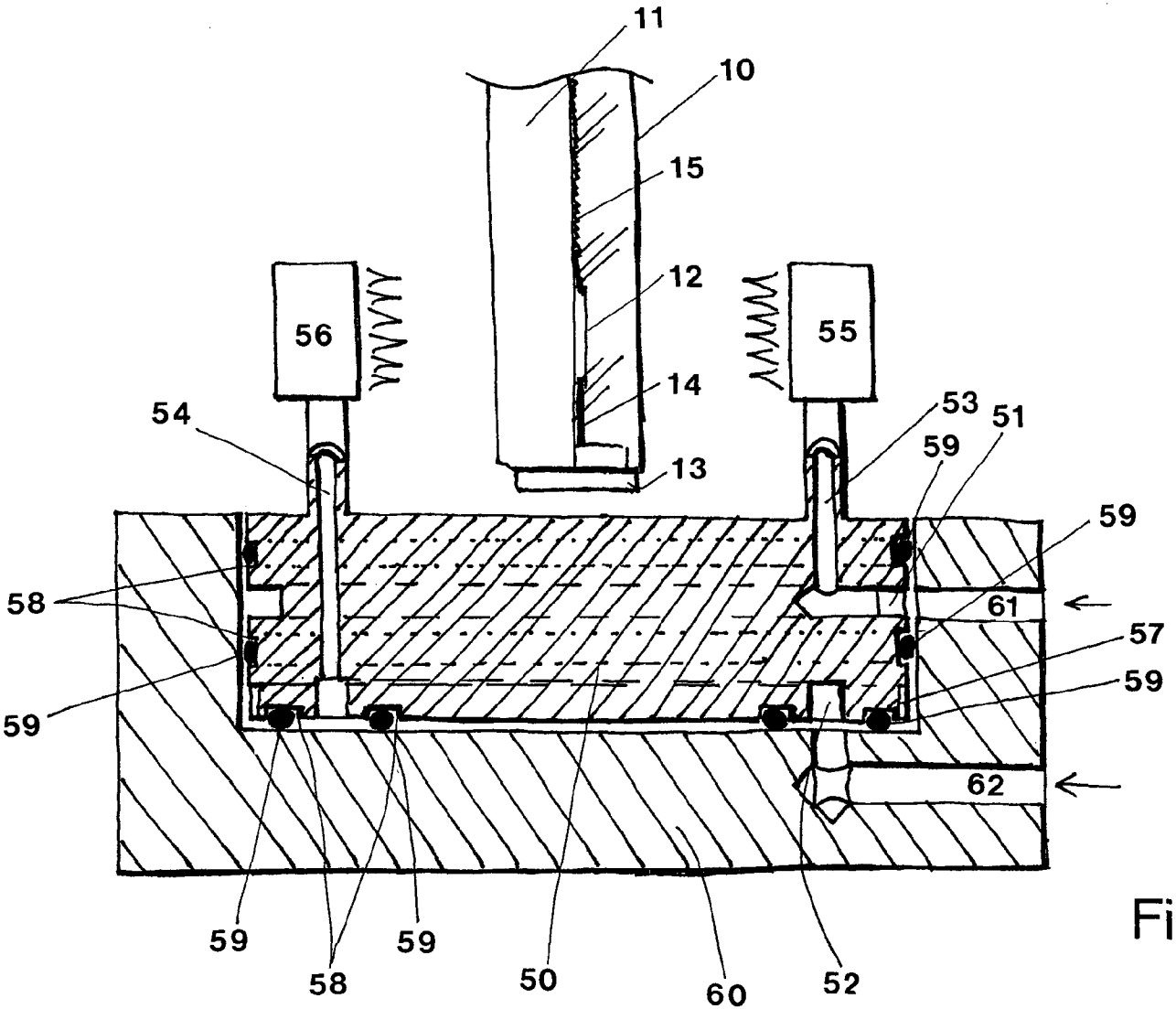
FIG. 2 is a schematic lateral sectional view of an arrangement of carrying out a method according to a preferred embodiment of the invention, with two opposing, rotating burners and individually regulated gas flows.

A cross-section of a system with rotating burners is shown in FIG. 2.

In a pinching machine for rotating burners the gas supply is optimized so that both burners are controlled independently of each other and as a function of the angular position. The burner output is increased in the region of the additionally applied reflector layer, so that the increase corresponds approximately to the additional mass located there.

Here, the rotating burner table 50 was provided with two separate gas supply grooves 51 and 52 from which supply lines 53 and 54 go to the two burners 55 and 56, respectively. The table is driven by a motor (not shown), which drives the milled gear 57 in the round burner table by gears. On both sides of the gas supply grooves 51, 52 there are additional grooves 58, in which 0-ring seals 59 are located.

The table is mounted in a receptacle 60, which also provides, in addition to the drive mechanism (not shown), the two gas feeds 61 and 62. Other gas mixtures or gas quantities could be added independent from each other by the two gas feeds. The gas quantities or gas mixtures are controlled by a gas regulator, shown, e.g., in FIG. 3, as a function of the angular position of the burner table.

The tube 10 with the applied reflector layer 11 to be pinched is here arranged so that the Mo film 12 to be pinched is located at the height of the burner. The components of the emitter are here fixed, e.g., by holders 13 placed on the tube ends and in which the outer molybdenum rod 14 is hooked, while the coil 15 holds all of the components in position in the interior of the emitter by its spring force.

During the pinching, argon is blown through the tube, in order to protect the inner components from oxidation.

In an actual case, a round tube with a diameter of 19 mm and a 1.6 mm wall thickness and a coating with a 0.8 mm thickness and a density of >95% of that of the lamp tube material was pinched, wherein this coating was deposited across 180° of the tube periphery. Here, the burners rotate with 1 revolution every 2 sec. In the region 30° before the burner points toward the reflector, the burner output is increased by 50% and then turned down again 30° before reaching the end of the reflector layer.

Here, the ratio of oxygen to hydrogen is switched from a lean premixed flame to a premixed flame close to the stoichiometric mixture fraction. The mixing point of the two gas flows is set directly before the inlet of the gases into the rotating burner head, so that the shortest possible paths are realized. Nevertheless, a rather high inertia of the flames is observed, so that an essentially sinus-shaped profile of the flame output is observed across the periphery.

Due to the wide expanding flame and heat conduction, it is possible to heat the tube through uniformly and quickly, so that, after its typical time and without observing a merging of the tube, the pinching can be performed. The emitters produced in this way have a negligible reject rate for a pinched section with an optically and mechanically clean construction.

Embodiment 3

System with rotating burners, as in Embodiment 2:

In a pinching machine for rotating burners, the gas supply was optimized so that both burners are controlled independently from each other and as a function of position. The burner output is then increased in the angular region of the additional applied reflector layer, so that the increase corresponds to approximately the additional mass located there.

In an actual case, a round tube with a diameter of 19 mm with a 1.6 mm wall thickness and a coating with a 0.8 nun thickness and a density of >95% of that of the lamp tube across 200° of the tube periphery was pinched. Here, the burners rotate at 1 revolution every 2 sec.

For regulating the burner output, the stoichiometry of the flame is left unaffected, but the output is varied by the outlet speed of the burner gases. The burner gas feed is increased by 30% for both burners 10° before reaching the reflector and is set back again 10° before reaching the end of the reflector. This process exhibits a faster reaction time than Embodiment 2, because the stoichiometric change does not have to first flow into the burners, but instead only the pressure wave must move from the regulators to the burner.

Due to the wide expanding flame and heat conduction, the tube is heated through uniformly and quickly, so that after a typical time and without a merging of the tube being observed, the pinching can be performed. Here also, no rejects are produced.

Embodiment 4

System with rotating burners:

In a pinching machine for rotating burners, the gas feed is optimized so that both burners are controlled independently from each other and as a function of position. The burner output is then increased in the region of the additional applied reflector layer, so that the increase corresponds approximately to the additional mass located there.

In an actual case, a twin tube with the dimensions 33×14 mm and with an average wall thickness of 1.8 mm and a coating with 0.9 thickness and a density of >95% of that of the lamp tube across 180° of the tube periphery was pinched. For this, the burners rotate at 1 revolution every 2 sec.

For regulating the output, the stoichiometry of the flame is left unaffected, but the output is varied by the outlet speed of the burner gases. The burner gas feed is increased by 40% for both burners 10° before reaching the reflector and set back again 10° before reaching the end of the reflector. In addition, in the region of the crosspiece, that is, when the flame strikes the surface of the flat side of the twin tube, the power is increased for a short time on both sides by another 30%.

Due to the wide expanding flame and heat conduction, the tube is heated through uniformly and quickly, so that after a typical time and without a merging of the tube being observed, the pinching can be performed. Thus, pinched sections are produced with only little necking. The reject rate lies at less than 3%.

Embodiment 5

Figure 3:
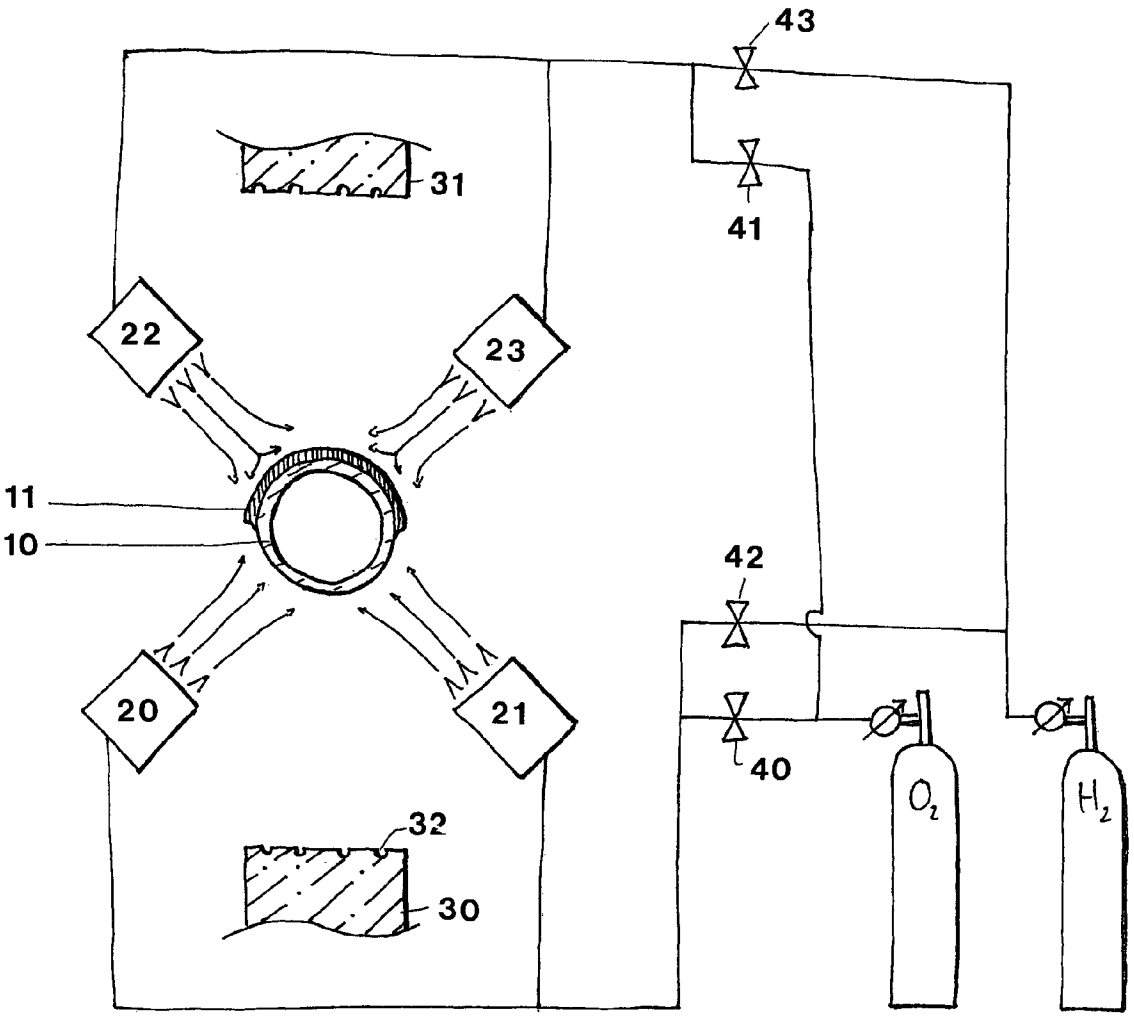
FIG. 3 is a schematic diagram of an arrangement for carrying out a method according to a preferred embodiment of the invention, with four stationary burners, which are regulated together in pairs.

A system with stationary burners is shown in FIG. 3:

In a pinching machine with four burners 20, 21, 22, 23 fixed in position, the gas feed was optimized so that two burners on each side are controlled together. The burner output is then increased in the region of the additional reflector layer 11 applied to the tube 10, such that the increase corresponds approximately to the additional mass located there.

In this case, the burner gases were hydrogen and oxygen and are taken from compressed bottles. The invention, however, is not limited either to the exact selection of burner gas or to the exact shape of the gas storage or feed.

By suitable pipe conduits, the gas flow is then distributed to the two burner groups and adjusted to the desired flow rates and stoichiometries shortly before the mixing points of the flows by regulators, in this case, mass-flow controllers (MFC). The invention, however, is not limited to the use of MFC. Floating-body flow regulators or any other suitable form for regulating gas quantities could be used just as well.

For each burner group, a regulator for oxygen 40, 41 and a regulator for hydrogen 42, 43 are used. In principle, each burner could naturally also be controlled individually.

In an actual case, a round tube with a diameter of 19 mm with a 1.6 mm wall thickness and a coating with a 0.8 mm thickness and a density of >95% of that of the lamp tube across 200° of the tube periphery was pinched.

In order to achieve an approximately uniform build-up pressure on the tube, the stoichiometry of the flames is selected differently. On the reflector side, the flames are operated close to the stoichiometric ratio. On the opposite side, a lean flame of equal impulse force, but with power reduced by 30%, is selected.

When the quartz glass reaches its temperature suitable for the pinching process, then the two pinching jaws 30, 31 move quickly toward each other and perform the pinching. For the mechanical reinforcement of the pinched section, grooves 32 are milled into the jaws, so that these grooves form raised sections on the pinched section.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A method for producing an infrared emitter from an endless quartz glass body, the method comprising applying a reflector layer at least partially on a surface of the quartz glass body, and dividing the quartz glass body into individual sections after application of the reflector layer, wherein the individual sections are formed by at least one rotating burner, and wherein the surface having the applied reflector layer is positioned closer to the one or more rotating burner than a non-coated surface.

2. The method according to claim 1, wherein the reflector layer is made of $SiO_2$.

3. The method according to claim 1, wherein the reflector layer is an opaque, diffuse scattering layer.

4. The method according to claim 1, wherein the individual sections are pinched at their ends by the at least one rotating burner.

5. The method according to claim 4, wherein the ends of the sections are pinched by two rotating burners.

6. The method according to claim 5, wherein the burners are operated by different gas flows.

7. An infrared emitter produced according to the method of claim 1.

* * * * *